US006454521B1

(12) United States Patent
Anderson et al.

(10) Patent No.: US 6,454,521 B1
(45) Date of Patent: Sep. 24, 2002

(54) WEAR RESISTANT FUEL PUMP

(75) Inventors: Philip Moore Anderson, Davison; David Edward Harris, Birch Run, both of MI (US)

(73) Assignee: Delphi Technologies, Inc., Troy, MI (US)

( * ) Notice: Subject to any disclaimer, the term of this patent is extended or adjusted under 35 U.S.C. 154(b) by 43 days.

(21) Appl. No.: 09/713,679

(22) Filed: Nov. 15, 2000

(51) Int. Cl.[7] ..... F04D 5/00

(52) U.S. Cl. ..... 415/55.1; 415/197; 415/170.1; 417/423.14

(58) Field of Search ..... 415/55.1, 55.2, 415/55.3, 55.4, 55.5, 196, 197, 170.1, 173.1, 200; 417/423.14, 415

(56) References Cited

U.S. PATENT DOCUMENTS 2,578,780 A * 12/1951 Bower ..... 415/174.1
3,111,904 A * 11/1963 Burns ..... 415/170.1
3,829,238 A * 8/1974 Speck ..... 415/197
4,052,133 A * 10/1977 Yeater ..... 415/197
6,095,771 A * 8/2000 Schelhas et al. ..... 415/197

* cited by examiner

*Primary Examiner*—John G. Weiss
*Assistant Examiner*—Richard Woo
(74) *Attorney, Agent, or Firm*—Vincent A. Cichosz

(57) ABSTRACT

A wear resistant fuel pump for a vehicle includes a pump section having a flow channel and a rotatable impeller cooperating with said flow channel to pump fuel therethrough. The fuel pump also includes a motor section disposed adjacent the pump section and having a motor to rotate the impeller. The fuel pump further includes an outlet section disposed adjacent the motor section to allow pumped fuel to exit the fuel pump. The pump section includes a plurality of plates disposed axially adjacent to and cooperating with the impeller. At least one of the plates includes a wear insert that improves abrasion wear characteristics therebetween.

18 Claims, 3 Drawing Sheets

WEAR RESISTANT FUEL PUMP

TECHNICAL FIELD

The present invention relates generally to fuel pumps for vehicles and, more particularly, to a wear resistant fuel pump for a vehicle.

BACKGROUND OF THE INVENTION

It is known to provide a fuel tank in a vehicle to hold fuel to be used by an engine of the vehicle. It is also known to provide a fuel pump to pump fuel from the fuel tank to the engine. One type of fuel pump is known as a high-pressure turbine fuel pump. The high-pressure turbine fuel pump typically includes a plastic impeller rotatable between solid materials such as anodized aluminum plates. The anodized aluminum material of the plates provides for a high wear resistant and high strength surface. However, a die casting process used to form the plates limits the geometric complexity and surface smoothness of a flow channel and port areas of the plates. Otherwise, the plates are machined to obtain complex shapes, which is relatively expensive. In addition, secondary operations are required for surface anodization and insertion of a journal bearing.

Improved geometry and surface smoothness can be obtained using injection or compression molded plastic plates. However, plastic plates have traditionally been limited in their applications due to poor abrasion wear resistance. Otherwise, the sealing surfaces of the plates wear, resulting in a reduction of fluid flow output.

Therefore, it is desirable to provide fuel pump for a vehicle having insert molded plates that improves the abrasive wear characteristics of plates. It is also desirable to provide a wear resistant fuel pump for a vehicle having insert molded plates with complex shapes. It is further desirable to provide insert molded plates in a fuel pump that improve wear resistance, strength, and surface smoothness.

SUMMARY OF THE INVENTION

It is, therefore, one object of the present invention to provide a wear resistant fuel pump for a vehicle.

It is another object of the present invention to provide a fuel pump for a vehicle having plates that are insert molded to improve the abrasive wear characteristics of the plates.

To achieve the foregoing objects, the present invention is a wear resistant fuel pump for a vehicle including a pump section having a flow channel and a rotatable impeller cooperating with said flow channel to pump fuel therethrough. The wear resistant fuel pump also includes a motor section disposed adjacent the pump section and having a motor to rotate the impeller. The wear resistant fuel pump further includes an outlet section disposed adjacent the motor section to allow pumped fuel to exit the fuel pump. The pump section includes a plurality of plates disposed axially adjacent to and cooperating with the impeller. At least one of the plates includes a wear insert that improves abrasion wear characteristics therebetween.

One advantage of the present invention is that a wear resistant fuel pump is provided for a vehicle. Another advantage of the present invention is that the wear resistant fuel pump has insert molded plates that improve the abrasive wear characteristics of the fuel pump. Yet another advantage of the present invention is that the wear resistant fuel pump reduces cost by eliminating or reducing machining and secondary operations. Still another advantage of the present invention is that the wear resistant fuel pump improves wear resistance and strength and allows complex shapes to be made at a relatively low cost. A further advantage of the present invention is that the wear resistant fuel pump has insert molded plates made into relatively simple shapes, thereby allowing more materials to be available for the wear resistant portion of the plate.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
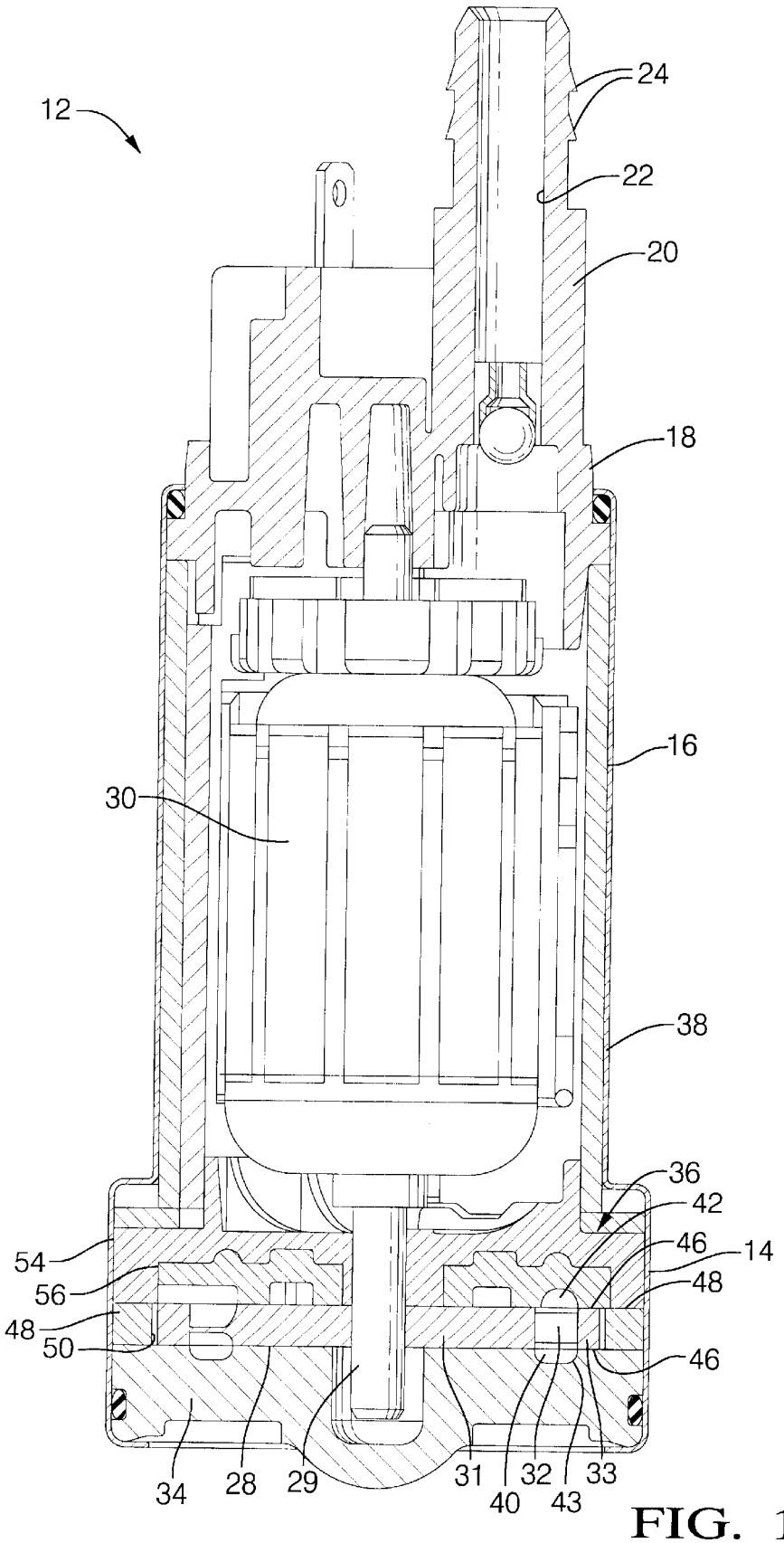
FIG. 1 is a fragmentary elevational view of a wear resistant fuel pump, according to the present invention.
Figure 2:
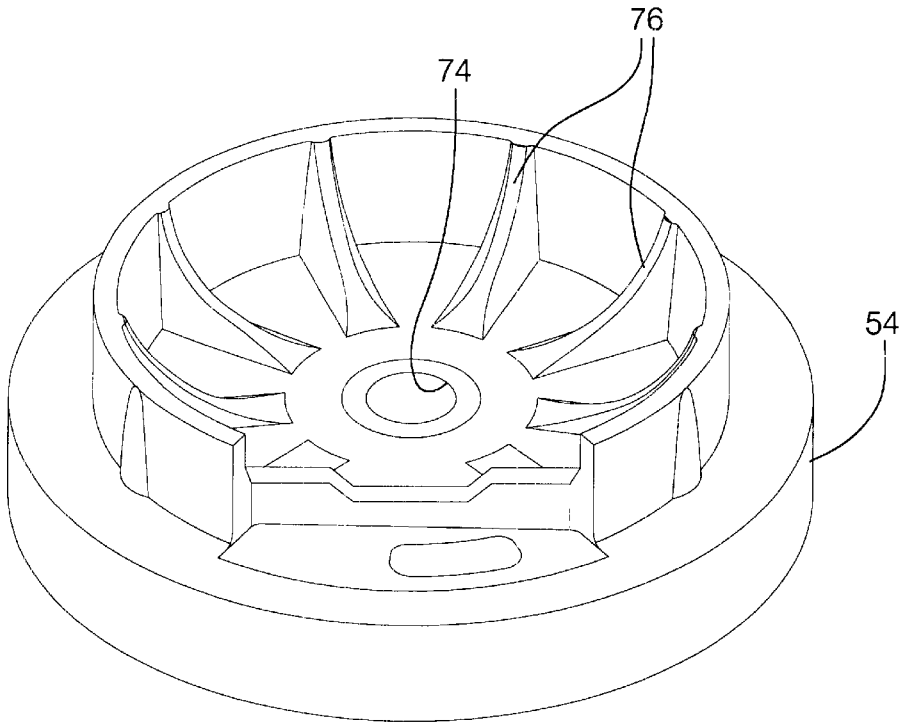
FIG. 2 is a perspective view of an outlet plate of the wear resistant fuel pump of FIG. 1.
Figure 3:
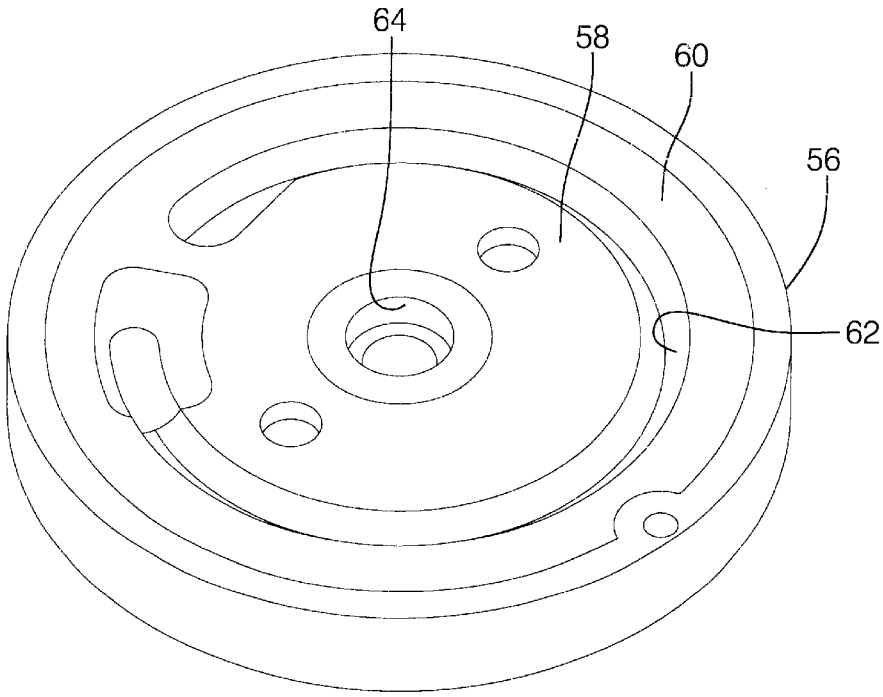
FIG. 3 is a perspective view of a portion of the outlet plate of FIG. 2.
Figure 4:
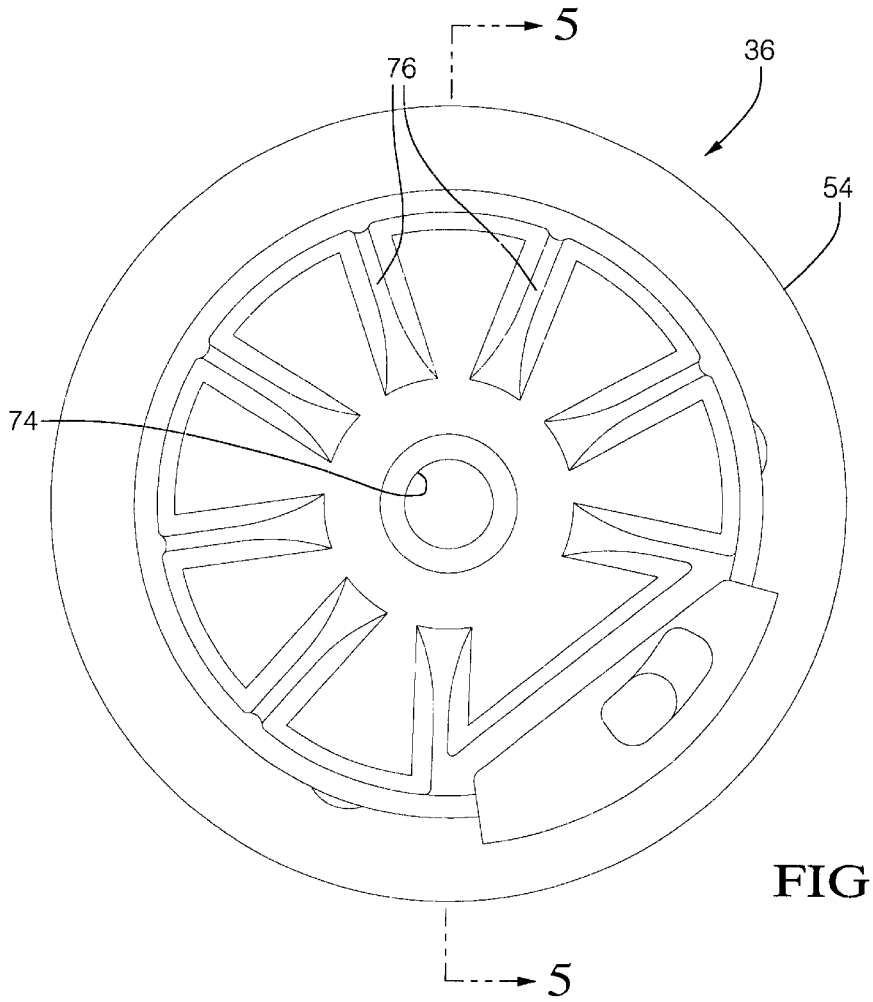
FIG. 4 is an enlarged plan view of the portion of FIG. 3.
Figure 5:
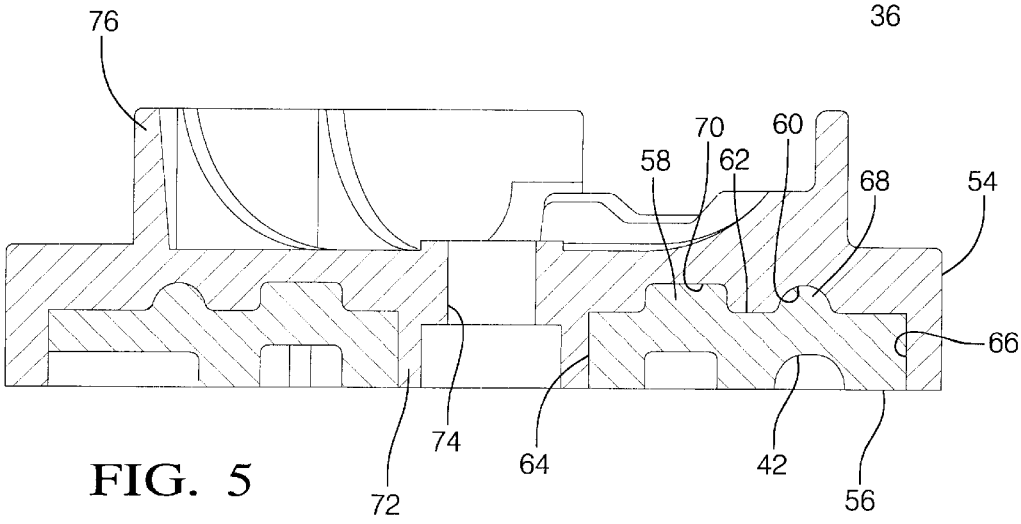
FIG. 5 is a sectional view taken along line 5–4 of FIG. 4.

Referring to the drawings and in particular FIG. 1, one embodiment of a wear resistant fuel pump 12, according to the present invention, is shown for a vehicle (not shown). The wear resistant fuel pump 12 includes a pump section 14 at one axial end, a motor section 16 adjacent the pump section 14 and an outlet section 18 adjacent the motor section 16 at the other axial end. As known in the art, fuel enters the pump section 14, which is rotated by the motor section 16, and is pumped past the motor section 16 to the outlet section 18. The outlet section 18 has an outlet member 20 extending axially with a passageway 22 extending axially therethrough. The outlet member 20 also has a plurality of projections or barbs 24 extending radially outwardly for attachment to a conduit (not shown). The outlet member 20 also includes a check valve 26 disposed in the passageway 22. It should be appreciated that the fuel flowing to the outlet section 18 flows into the outlet member 20 and through the passageway 22 and check valve 26 when open to the conduit. It should also be appreciated that, except for the pump section 14, the fuel pump 12 is conventional and known in the art.

Referring to FIGS. 1 through 6, the pump section 14 includes an impeller 28 mounted to a rotatable shaft 29 of a motor 30 of the motor section 16 for rotation therewith. The impeller 28 is generally planar and circular in shape. The impeller 28 has a hub portion 31 attached to the shaft 29 by suitable means (not shown). The impeller 28 also has a plurality of blade tips 32 extending radially from the hub portion 31 and disposed circumferentially thereabout. The impeller 28 has a peripheral ring portion 33 extending radially from the blade tips 32 to shroud the blade tips 32. The impeller 28 is made of a rigid material such as plastic.

The pump section 14 also includes an inlet plate 34 disposed axially on one side of the impeller 28 and an outlet plate, generally indicated at 36, disposed axially on the other side of the impeller 28. The inlet plate 34 and outlet plate 36 are generally circular in shape. The inlet plate 34 and outlet plate 36 are enclosed by a housing 38 and fixed thereto. The inlet plate 34 and outlet plate 36 have an inlet or first recess 40 and an outlet or second recess 42, respectively, located axially opposite the blade tips 32 adjacent to the peripheral ring portion 33 to form a flow channel 43 for a function to be described. The recesses 40 and 42 are annular and allow fuel to flow therethrough from an inlet port (not shown) to an outlet port (not shown) of the pump section 14. The peripheral ring portion 33 of the impeller 28 forms an outside diameter (OD) sealing surface 46 on both axial sides thereof with the inlet plate 34 and outlet plate 36. It should be appreciated that the impeller 28 rotates relative to the inlet plate 34 and outlet plate 36 and the inlet and outlet plates 34 and 36 are stationary.

The pump section 14 also includes a spacer ring 48 disposed axially between the inlet plate 34 and outlet plate 36 and spaced radially from the impeller 28. The spacer ring 48 is fixed to the housing 38 and is stationary relative to the impeller 28. The spacer ring 48 is generally planar and circular in shape. The spacer ring 48 has an inner diameter that is spaced from the outside diameter of the peripheral portion 33 of the impeller 28 to form an outside diameter (OD) cavity 50 between the inner diameter of the spacer ring 48 and an outside diameter of the peripheral ring portion 33 of the impeller 28. It should be appreciated that fluid flows through both the inlet plate recess 40 and the outlet plate recess 42 and enters both recesses 40 and 42 at the inlet port region and exits out the outlet port region, Referring to FIG. 2 through 5, either one or both the inlet plate 34 and/or outlet plate 36 are made of a composite material to improve the material abrasive wear resistance. The composite material is a plastic base resin material 54 and a wear insert 56 (FIG. 3) insert molded into the plastic base resin material 54. The wear insert 56 is generally circular in shape. The wear insert 56 has the second recess 42 located on a lower surface thereof. The wear insert 56 has an annular first projection 58 extending upwardly from an upper surface thereof and circumferentially thereabout. The wear insert 56 has an annular second projection 60 extending upwardly from an upper surface thereof and circumferentially thereabout. The second projection 60 is spaced radially from the first projection 58 by a flow channel 62 extending circumferentially between the second recesses 42. The wear insert 56 includes a central aperture 64 extending axially therethrough for a function to be described. The wear insert 56 is made of a high wear resistant material such as stainless steel, high carbon steel, ceramics, etc. that can be fabricated into a wear insert 56. The wear insert 56 has a hardness equal to or greater than the hardness of an abrasive contaminant, for example quartz, $R_c$32 64, silica ingested by the fuel pump 12 during operation and causing abrasive wear. The wear insert 56 is formed or fabricated by conventional methods such as fine blanking, powdered metal sintering, powdered metal injection molding, ceramic injection molding, machined, etc. It should be appreciated that the wear insert 56 has a diameter less than a diameter of the base resin material 54. It should also be appreciated that the wear insert 56 provides high strength, wear resistance, and a smooth contact and sealing surface against the impeller 28.

The base resin material 54 is molded around the wear insert 56 to form a desired or predetermined shape. The base resin material 54 has a generally circular shape. The base resin material 54 has a cavity 66 extending axially and radially into a lower surface thereof to receive the wear insert 54. The cavity 66 has an annular first recess 68 extending radially inwardly from an upper surface thereof and circumferentially thereabout to receive the first annular projection 58. The cavity 66 has an annular second recess 70 extending radially from an upper surface thereof and circumferentially thereabout to receive the second annular projection 60. The second recess 70 is spaced radially from the first recess 68 by a flow channel 62 extending circumferentially between the second recesses 42. The base resin material 54 has a projection 72 extending axially through the central aperture 64 and an aperture 74 extending axially therethrough to allow the shaft 29 of the motor 30 to extend axially therethrough for connection to the impeller 28. The base resin material 54 also includes at least one, preferably a plurality of vanes 76 extending upwardly from an upper surface thereof and spaced circumferentially. The base resin material 54 is made of a suitable plastic material such as a thermoformable plastic that can be molded over the wear insert 56. The base resin material 54 has a hardness less than a hardness of the wear insert 56. The base resin material 54 is molded or fabricated by conventional methods such as plastic injection molding, which are conventional and known in the art. The base resin material 54 is bonded to the wear insert 56 both mechanically and chemically. It should be appreciated that the overmoulding provides the complex shapes needed for high efficient pump sections and the mating features for the fuel pump 12.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

We claim:

1. A wear resistant fuel pump for a vehicle comprising:

a pump section having a flow channel and a rotatable impeller cooperating with said flow channel to pump fuel therothrough;

a motor section disposed adjacent said pump section and having a motor to rotate said impeller;

an outlet section disposed adjacent said motor section to allow pumped fuel to exit said fuel pump; and said pump section including an inner plate and an outer plate disposed axially adjacent to and cooperating with said impeller, at least one of said inner plate and said outer plate comprising a plastic base resin material having a cavity and a wear insert disposed in said cavity of said base resin material that improves abrasion wear characteristics thereberween, wherein said wear insert has a diameter less than a diameter of said base resin material.

2. A wear resistant fuel pump as set forth in claim 1 wherein said at least one of said plates comprises said wear insert and a base resin material molded over said wear insert.

3. A wear resistant fuel pump as set forth in claim 2 wherein said wear insert has a hardness greater than a hardness of said base resin material.

4. A wear resistant fuel pump as set forth in claim 2 wherein said wear insert has a hardness greater than 65 Rc.

5. A wear resistant fuel pump as set forth in claim 2 wherein wear insert is made of one of a group comprising stainless steel, high carbon steel, and ceramic.

6. A wear resistant fuel pump as set forth in claim 2 wherein said wear insert has a first projection extending upwardly from an upper surface thereof.

7. A wear resistant fuel pump as set forth in claim 6 wherein said wear insert includes a second projection extending upwardly from the upper surface thereof and spaced radially from said first projection.

8. A wear resistant fuel pump as set forth in claim 7 wherein said base resin material includes a first recess extending radially from said cavity to receive said first projection.

9. A wear resistant fuel pump as set forth in claim 8 wherein said base resin material includes a second recess extending radially from said cavity to receive said second projection.

10. A wear resistant fuel pump as set forth in claim 2 wherein base resin material includes an aperture extending axially therethrough.

11. A wear resistant fuel pump for a vehicle comprising a housing;

a pump section disposed in said housing having a flow channel and a rotatable impeller cooperating with said flow channel to pump fuel therethrough;

a motor section disposed in said housing adjacent said pump section and having a motor to rotate said impeller;

an outlet section disposed in said housing adjacent said motor section to allow pumped fuel to exit said fuel pump; and said pump section including an inner plate and an outer plate disposed axially adjacent to and cooperating with the impeller, at least one of said inner plate and said outer plate comprising a wear insert and a base resin material having a cavity to receive said wear insert, said base resin material being molded over said wear insert that improves abrasion wear characteristics therebetween, wherein said wear insert has a diameter less than a diameter of said base resin material.

12. A wear resistant fuel pump as set forth in claim 11 wherein said wear insert has a hardness greater than a hardness of said base resin material.

13. A wear resistant fuel pump as set forth in claim wherein said wear insert has a hardness greater than 65 Rc.

14. A wear resistant fuel pump as set forth in claim 11 wherein said wear insert has a first projection extending upwardly from an upper surface thereof.

15. A wear resistant fuel pump as set forth in claim 14 wherein said wear insert includes a second projection extending upwardly from the upper surface thereof and spaced radially from said first projection.

16. A wear resistant fuel pump as set forth in claim 15 wherein said base resin material includes a first recess extending radially from said cavity to receive said first projection.

17. A wear resistant fuel pump as set forth in claim 16 wherein said base resin material includes a second recess extending radially from said cavity to receive said second projection.

18. A wear resistant fuel pump for a vehicle comprising:

a housing;

a pump section disposed in said housing having a flow channel and a rotatable impeller cooperating with said flow channel to pump fuel therethrough;

a motor section disposed in said housing adjacent said pump section and having a motor to rotate said impeller;

an outlet section disposed in said housing adjacent said motor section to allow pumped fuel to exit said fuel pump; and said pump section including an inner plate and an outer plate disposed axially adjacent to and cooperating with the impeller, at least one of said inner plate and said outerplate comprising a wear insert and a base resin material having a cavity to receive said wear insert, said base resin material being molded over said wear insert, said wear insert having a hardness greater than 65 Rc to improve abrasion wear characteristics with said impeller, wherein said wear insert has a diameter less than a diameter of said base resin material.

* * * * *